United States Patent [19]

Stobb

[11] 3,969,993

[45] July 20, 1976

[54] SEPARATOR FOR A SHEET STACKER

[75] Inventor: Anton R. Stobb, Pittstown, N.J.

[73] Assignee: Stobb, Inc., Clinton, N.J.

[22] Filed: July 7, 1975

[21] Appl. No.: 593,849

[52] U.S. Cl. ..... 93/93 C; 93/93 DP; 271/218

[51] Int. Cl.[2] ..... B31B 1/98

[58] Field of Search ..... 93/93 C, 93 DP, 93 R, 93/93 M, 93 D; 214/8.5 SS, 8.5 R, 6 R; 271/182, 183, 202, 213, 214, 217–219

[56] References Cited

UNITED STATES PATENTS

| | | | |
|---|---|---|---|
| 2,819,661 | 1/1958 | Howdle et al. | 93/93 DP |
| 3,362,707 | 1/1968 | Laurén | 271/218 |
| 3,526,170 | 9/1970 | Oderman et al. | 93/93 DP |
| 3,585,909 | 6/1971 | Carrel | 93/93 DP X |
| 3,679,072 | 7/1972 | Mueller | 93/93 DP X |
| 3,831,505 | 8/1974 | Skogsberg | 93/93 DP |
| 3,866,765 | 2/1975 | Stobb | 214/8.5 SS |

*Primary Examiner*—James F. Coan
*Attorney, Agent, or Firm*—Arthur J. Hansmann

[57] ABSTRACT

A separator for a sheet stacker having a support for receiving a stack of sheets on a stack conveyor. Another conveyor brings a stream of sheets to the support, and a sheet counter counts the sheets and a stack separator plate is controlled by the counter and interrupts the stream when a certain number of sheets have passed into the stack. Drive mechanism connects to the separator plate and the stack conveyor for alternately driving them and thereby separating out a stack of sheets. The separator plate is automatically operated and is under the control of a fluid cylinder.

12 Claims, 6 Drawing Figures

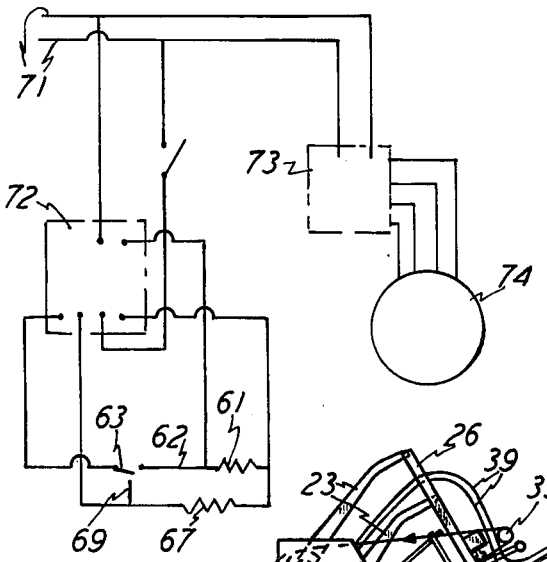
FIG. 4
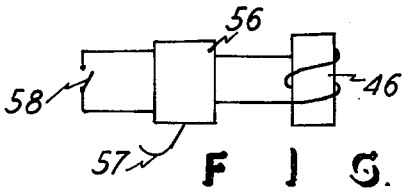
FIG. 5
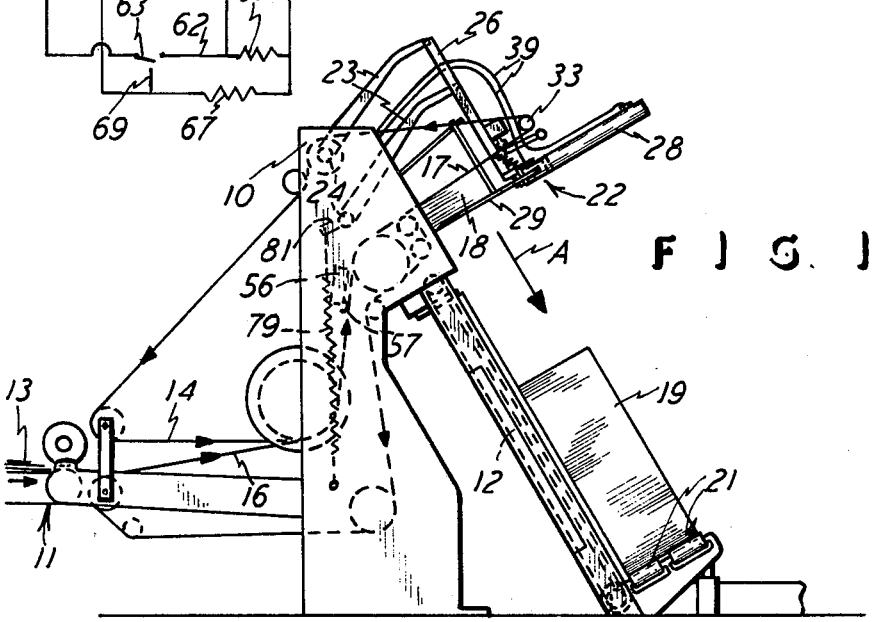
FIG. 1
FIG. 6
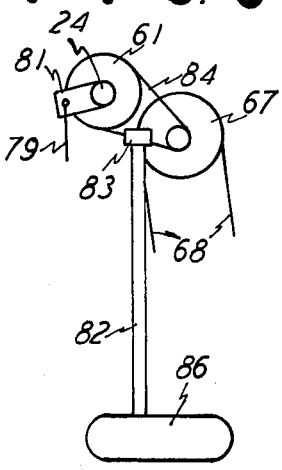
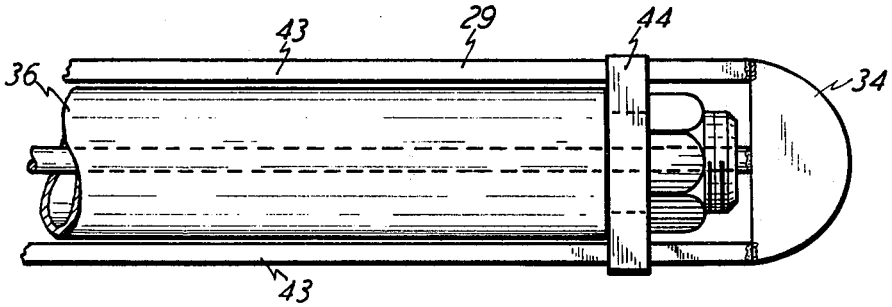
FIG. 3

SEPARATOR FOR A SHEET STACKER

This invention relates to a separator for a sheet stacker, and, more particularly, it relates to providing an automatic separator plate for use with a sheet stacker which receives sheets from a printing press or folder or the like, and thereby the apparatus separates the sheets into a stack of a selected number of sheets.

BACKGROUND OF THE INVENTION

The prior art already is aware of and utilizes sheet stackers in many different forms. These stackers are commonly in the form of conveyors and receivers which handle a stream of sheets coming from a folder or a printing press or the like, and the stackers form the sheets into a collected stack. One example of a prior art stacker is found in my U.S. Pat. No. 2,933,341 which shows stacker apparatus having an incoming conveyor which transports a stream of sheets to a stack conveyor whereon the sheets are repositioned from their stream relation and into an aligned stack. Another example of apparatus for handling sheets and arranging them in a stack and subsequently handling the stack is found in my U.S. Pat. No. 3,739,924.

Also, the prior art is already aware of apparatus and stacker arrangements wherein the stacked sheets are separated into discrete piles or stacks, and the prior art commonly utilizes a so-called separator plate for dividing the formed stack into the smaller and discrete stack, and this is also shown in my U.S. Pat. No. 2,933,314. Still further, separator plates which are under the control and influence of powered mechanism, such as a fluid cylinder, are utilized in the stacker industry, and an example of such is found in U.S. Pat. No. 3,866,765. However, in the examples given herein, the separator plates, whether they are manually controlled or power controlled, both as mentioned above they are only utilized for separating a stack itself, and they are not shown in those references as being used on an imbricated stream of sheets for interrupting the flow of the stream into the final stack. Accordingly, accurate count of the sheets in the final stack is not likely nor accomplished in the prior art.

The present invention provides a separator for a sheet stacker wherein the separator itself is automatically operative and responds to the count of a certain number of sheets passing into the stack. Further, in accomplishing this objective, the apparatus of this invention permits continuous operation and thereby permits continuous collecting and stacking of the sheets into their discrete stacks of accurate numbers of sheets.

Another object of this invention is to provide a separator for a sheet stacker wherein the functions of transporting a stream of sheets and collecting the stream in a stack and separating the sheets into certain numbers in each stack, are all automated and are continuously and accurately performed in their respective functions. Accordingly, the apparatus of this invention operates without interruption and the flow of sheets is continuous while providing the accurate number of sheets in the plurality and continuous numbers of stacks produced by the apparatus.

In summary, the present invention improves upon the prior art by providing a separator for a sheet stacker which is completely automated and which provides an accurate count of the sheets moving into the final stack, and the operator needs to only monitor the apparatus or perform only minimal unskilled tasks during the operation of the apparatus.

Other objects and advantages will become apparent upon reading the following description in light of the accompanying drawings.

BRIEF DESCRIPTION OF THE DRAWINGS

FIG. 1 is a side elevational view of a stacker incorporating an embodiment of this invention.

FIG. 3 is a bottom plan view of a portion of the apparatus shown in FIG. 2, and with the plate in the retracted position.

FIGS. 4 and 5 are electric schematic views of the apparatus included in this embodiment.

FIG. 6 is a side elevational view of some of the drive apparatus utilized in this embodiment.

DETAILED DESCRIPTION OF THE PREFERRED EMBODIMENT

Figure 2:
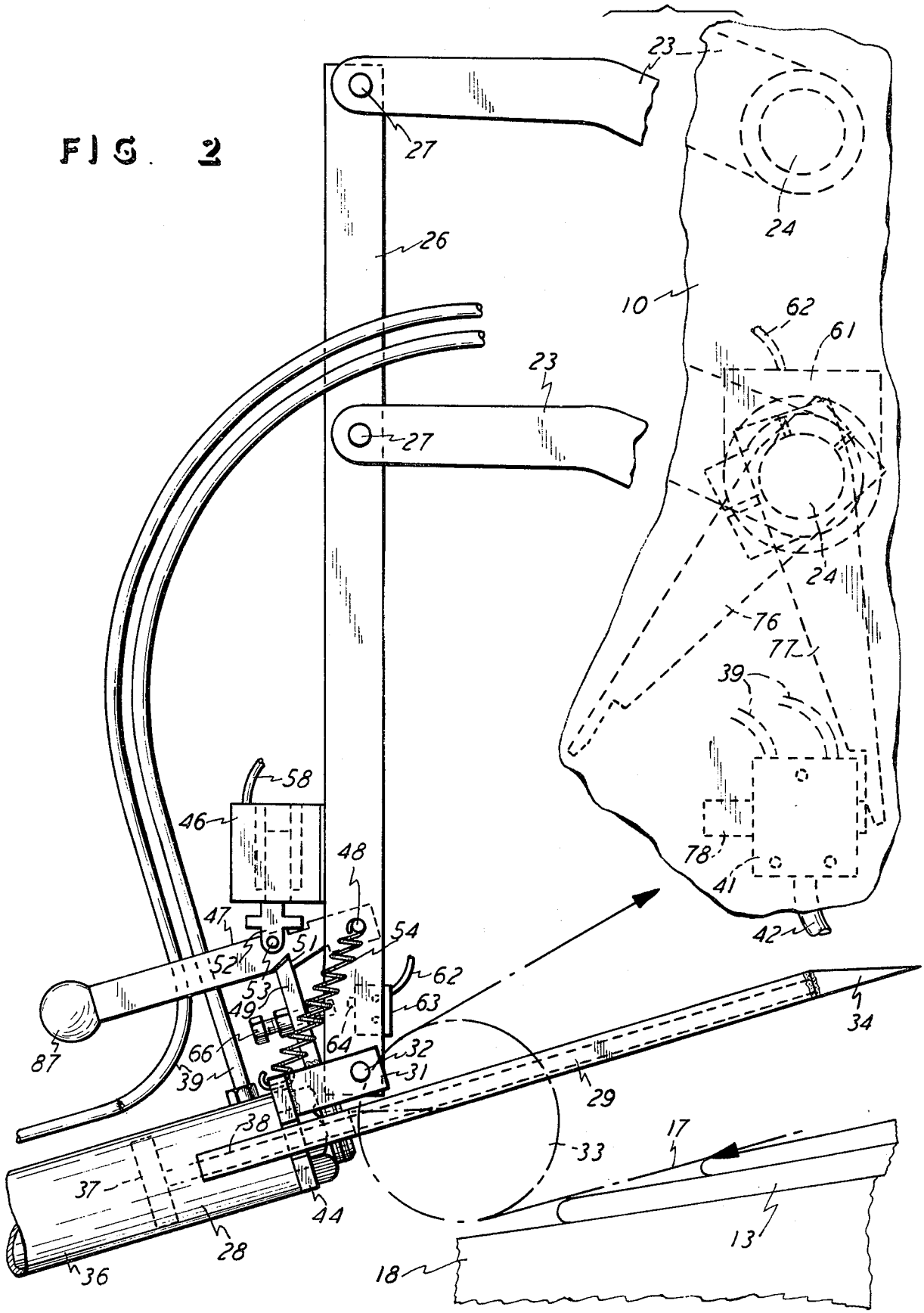
FIG. 2 is an enlarged side elevational view of a fragment of the apparatus shown in FIG. 1, and being taken from the side opposite.

FIG. 1 generally shows a stacker having a support or frame member 10 and it shows an incoming conveyor 11 and a stack or collecting conveyor 12, with the conveyors 11 and 12 related to the support 10 by having the conveyor 11 extending thereto and by having the conveyor 12 positioned thereon. Thus, the conveyor 11 may come from a folder or a printing press (neither of which is shown) and it supports the stream of sheets designated 13 which are shown in their usual shingled or imbricated relation. The stream 13 thus passes between the conveyors 14 and 16 and in the direction of the arrows shown thereon, and the stream passes to the conveyor portion 17 where the stream is initially formed in a stack designated 18, and the stack 18 is formed in the usual and well-known manner, such as shown and described in my U.S. Pat. No. 2,933,314, for instance. Continuous movement of the stream 13 into the stack designated 18 will increase the size of the stack 18, and ultimately the stack 18 will pass to the stack conveyor 12 which is of a conventional arrangement and utility, such as also shown in my U.S. Pat. No. 2,933,314. Thus, the stack 18 ultimately becomes a full stack, such as shown by the stack designated 19 which has passed in the direction of the arrow A down to the bottom rollers or support 21 on the stacker support or frame 10, all in a conventional manner and arrangement. Thus, the stack conveyor 12 may be the chain type conveyor, such as indicated in my referenced patent, and it will of course be powered and supported for receiving the stack 18 and controlling it in the formation of the final stack and the final positioning of the stack 19.

In this arrangement, the present invention is concerned with separating the sheets which are forming the stream 13, and to thereby cause them to be positioned in the final stack 19 in a selected count or number of sheets. To accomplish this, a separator plate assembly, generally designated 22, is movably positioned on the support 10 and it initially intercepts the sheets in their stream relation and then guides the initial stack 18, downwardly as shown in FIG. 1, and the stack 19 is then lowered away from the stack portion 18 and is handled for binding or transportation to another station, perhaps as shown in my U.S. Pat. No. 3,739,924, for instance.

FIGS. 1 and 2 show that the assembly 22 includes pivot arms 23 which are suitably pivotally supported on the frame or support 10 at the pivot points designated 24, and the extending ends of the arms 23 are pivotally connected to a link 26 at pivot points designated 27. Finally, an assembly of a fluid cylinder assembly 28 and a separator plate 29 are pivotally mounted on the lower end of the link 26, by means of a bracket 31 and a pivot pin 32 extending through the bracket 31 and through the lower end of the link 26. Thus the assembly of the members 28 and 29 pivot about the pin 32, and it will be seen that when the plate 29 is in the extended position of FIG. 2 and with the links and arms 23 and 26 in the raised position of FIG. 2, then the separator plate 29 is above the lower extent of the belt 17 which is trained about the pulley designated 33. Accordingly, it will be seen and understood that if and when the plate 29 and the cylinder assembly 28 pivot about the pin 32 to have the plate 29 lower at its pointed or extended end 34, as seen in FIG. 2, then the plate 29 will have its tip 34 extend below the belt 17 and into the stream 13 to thereby intercept the sheets in the stream 13 and thus separate the sheets and define the bottom of the stack 18, as indicated in FIG. 1.

The cylinder assembly 28 is a fluid cylinder assembly having a cylinder 36 and a piston 37 and a piston rod 38 which is shown to extend to the tip 34. The cylinder assembly 28 may be of the air or hydraulic type, and it has the usual fluid hoses 39 connected thereto at opposite ends to form a two-way acting cylinder, and the hoses 39 extend to a control valve designated 41 and mounted on the support 10 and having a fluid supply hose 42 connected thereto, as more fully described hereinafter. The separator plate 29 is shown to be bifurcated and has portions 43 extending along opposite sides of the cylinder 36, when in the retracted position and as shown in FIG. 3. Also, the end of the cylinder 36 has a guide plate 44 in which the separator plate legs or side portions 43 are slidably guided. Thus, the plate 29 can extend and retract between the FIG. 2 and FIG. 3 positions, respectively, under the influence of the actuation of the cylinder assembly 28. Thus, the plate 29 will be extended when it is in the ready position of FIG. 2 and when it is in the stack-supporting position of FIG. 1 as the stack 18 is growing. Subsequently, the plate 29 will be retracted when it is desired to release the stack 18 and reposition the assembly 22 to its upward position of FIG. 2, as more fully described hereinafter.

Further, it will be seen and understood that the assembly 22 can move up and down, by virtue of the movable support provided by the arms 23 and the link 26 which connect to the assembly 22. Thus the movement of the assembly 22 is in the directions of the longitudinal extent of the stack conveyor 12, that is, in the up-and-down directions relative to the shown inclined direction of the stack conveyor 12. Thus the support and mounting mechanism for the assembly 22 is a part of the control mechanism for the assembly 22.

Additional control mechanism for the assembly 22 includes an electric solenoid member 46 affixed to the arm 26 and a lever 47 pivoted to the arm on the pin 48. A pawl 49 extends affixed and upwardly from the assembly 22 and engages a notch 51 in the latch member 47. Also, the solenoid assembly 46 has a depending arm 52 which is pivoted at 53 to the latch member 47. Thus, as seen in FIG. 2, the assembly 22 is held in the tilted position shown, by virtue of the engagement of the latching members 47 and 49. However, it will be seen and understood that when the solenoid 46 is energized, then its arm 52 is retracted upwardly to thereby release the latch 47 from the arm 49, and the assembly 22 can then be overbalanced toward the plate 29, and, at that position, the plate point 34 tips downwardly to intercept the sheets in the stream 13. At this time it will also be noticed that a tension spring 54 assists the tipping of the assembly 22 to the position where the point 34 will engage the incoming stream 13, as described, and the spring 54 is of course connected between the pin 48 and the cylinder guide member 44, as shown.

FIG. 1 shows that there is an electric counter 56 moutned on the support 10 and disposed adjacent the belts 14 and 16 at the entrance of the stream into the stack 18. The counter 56 is of a conventional construction available commercially on the market, and it may have any type of feeler or like member designated 57 which can engage the sheets in the stream 13 and thereby respond to the passing of the sheets 13 and thus count the sheets passing the counter 56. The counter 56 is therefore an electric switch which is electrically connected, such as through the wire designated 58, to the solenoid 46 to thereby actuate the solenoid 46 after a certain number of sheets have been counted by the counter 56. It will therefore now be understood that when a certain number of sheets have passed the counter 56 and moved into the stack, such as the stack 18 though that stack would be much larger than the one shown in FIG. 1, then the switch 56 would close and thereby energize the solenoid 46 to release the latch members 47 and 49 and permit the separator plate 29 to tip into a position for intercepting the sheets in the stream 13, as described. In this manner, the counter 56 would be effective to permit a certain number of sheets to pass into the stack 18, and the remainder of the sheets in the stream 13 would then be intercepted by the separator plate 29, for the formation of the next stack as the counter 56 continues to count the sheets passing the counter 56.

At this time it will then also be seen and understood that the assembly 22 will lower as the stack 18 continues to grow on the separator plate 29 which is then moving downwardly by means hereinafter described. FIG. 5 shows an electric schematic with the switch 56 and a feeler or actuator member 57 which can be in contact with the sheets and thereby register the passing of each of the sheets in the stream 13, and the actual switch unit 58 of the counter 56 is then closed, and FIG. 5 further shows the solenoid elements 46 which are electrically connected with the switch 56, all in a conventional arrangement of having a counter with an electric switch and energizing a solenoid.

FIGS. 2, 4, and 6 show electrical and mechanical drive arrangements for lowering the support members for the assembly 22 and also for driving the stack conveyor 12, and these drives are alternately energized through respective electric or like clutches, such as the clutch 61 mounted on the support 10 and being in control of the rotation of the shaft 24 which in turn controls the pivotal position and drive of the lower arm 23. Thus, an electric wire 62 is shown extending to the clutch 61, and the wire extends to a switch 63 which is mounted on the lower end of the arm 26. The switch 63 is shown to have an actuation button or trip member 64 which is in the free or untripped position in FIG. 2. Also, the assembly 22 has a screw 66 whose end aligns with the button 64, such that, upon release of the latching members 47 and 49, the screw 66 abutts the button 64 and thereby sets the micro-switch 63 in one position, and that position is one which energizes the clutch 61 to cause the shaft 24 to rotate counterclockwise and thereby lower the assembly 22 in unison with the speed of the incoming sheets forming the stack 18 which is now supported on the plate 29. The micro-switch 63 is also connected to another electric clutch which is shown in FIGS. 4 and 6 and is designated 67 which, such as through the drive connection 68, is in driving relation with the stack conveyor 12. Therefore, with the arrangement of the switch 63, being substantially a conventional type switch for alternately energizing clutches 61 and 67, electric power is transmitted alternately for alternate drive of the lowering of the mechanism 22 and the operation of the stack conveyor 12. With still further explanation, when the mechanism 28 is under control of the switch 63 through the clutch 61, as described, then the drive to the stack conveyor 12 is declutched or interrupted so that the conveyor 12 can descend and thus carry the stack of sheets downwardly to the position shown with regard to the stack 19 in FIG. 1. Any suitalbe drive connection can be arranged between the clutch 67 and the stack conveyor 12, such as that shown or any one which would be known and obvious to one skilled in the art. FIG. 4 further shows that the switch 63 is thus in the normally open position when it connects with the line 62 and to the clutch designated 61; and the switch 63 is in the normally closed position when it connects with the line designated 69 and to the clutch 67. FIG. 4 further shows the electric elements shown and described herein, and it shows the power line leadin wires 71 and a junction box designated 72 and including fuses, and it shows a control panel designated 73 and an electric motor designated 74, all for constituting the electric components and their interrelation as shown and described herein.

The lower pivot shaft 24 has two arms 76 and 77 affixed thereto for rotation therewith, and the extending ends of the arms engage a valve actuator 78 on the fluid valve 41. Thus, when the assembly 28 lowers to a sufficient position, the arm 76 engages the actuator 78 and reverses the valve 41 to cause the assembly 28 to retract the plate 29, since the fluid lines 39 connect with the valve 41 and with the cylinder 36, as indicated in FIG. 2. Upon retraction of the separator plate 29 as described, the assembly 22 is overbalanced and placed into the orientation shown in FIG. 2, and this therefore resets the switch 63 to where the emain clutch or stack conveyor clutch 67 is engaged for lowering the stack in a controlled manner.

To return the assembly 28 to its upper position shown in FIG. 2, a tension spring 79 connects at its lower end to the support 10 and at its upper end to an arm 81 on the shaft 24, as also shown in FIG. 6. The spring 79 thus returns the assembly 28 to its upper position when the assembly 28 is relieved of supporting the stack 18, as just described. When the assembly 28 is in the FIG. 2 position, the arm 77 then engages the valve button 78 to reverse the flow through the fluid valve 21 and then cause the plate 29 to extend to its full line position shown in FIG. 2 and thereby reset the mechanism for another interception of the sheets in the stream 13. Of course as soon as the counter 56 registers the suitable and selected number of sheets passing into the stack 18, then the solenoid 46 is again energized and the plate 29 is positioned to intercept the sheets in the stream 13 and thus the switch 63 is again actuated and thus the clutch 67 is declutched and the sheets then formed in the stack on the stack conveyor 12 are allowed to move downwardly to the position shown with regard to the stack 19 in FIG. 1, as mentioned above.

FIG. 6 shows a drive shaft 82 extending to a gear 83 which is in driving relation with the clutch 67, and a drive chain or the like 84 extends between the clutches 67 and 61, as shown. A power unit, which may include an electric motor 86 is incorporated in a housing at the lower end of the support 10, and this may also be in the nature of the drive and relationship of elements shown in my U.S. Pat. No. 2,933,314, and the motor 74 may be the motor designated 76 in relation to the FIG. 6 showing.

FIG. 2 shows the member 47 has a knob 87 on the end thereof, and the knob is available for manual maneuvering so that the operator can release the latching members 47 and 49, without waiting for the control by the solenoid 47.

Accordingly, the apparatus is arranged so that the counter 56 counts a selected number of sheets and energizes the solenoid 46 to position the plate 29 to thereby intercept the sheets in the stream 13. At the same time, the screw 66 actuates the switch 63 which thereby causes the clutch 61 to be energized and thus the assembly 28 is lowered; and, at that time, the main clutch 67 is declutched and thus the previous stack, such as the stack 19 moves freely with the conveyor 12 which is now not under power control, and down to the position shown in FIG. 1. Subsequently, the fluid valve 41 is tripped by the arm 76 and thus the plate 29 is retracted and the spring 79 moves the assembly 28 back to its upper position, and that action again actuated switch 63 so that this time the clutch 67 is energized and the conveyor 12 is now powered to uniformly lower the stack 18 or 19 and thereby collect the signatures until the process is repeated.

What is claimed is:

1. A separator for a sheet stacker, comprising a support for receiving a stack of sheets, a stack conveyor on said support, a conveyor assembly extending to said support for transporting sheets in a stream and into a stacked relation on said stack conveyor, a sheet counter for counting the sheets passing into the stacked relation, a stack separator plate movably mounted adjacent said stack conveyor for movement into said stream for intercepting said stream and for movement in the direction along the extent of said stack conveyor for defining one end of a stack of sheets on said stack conveyor, control mechanism operatively connected with said stack separator plate for movement of said stack separator plte into the stream, and said sheet counter and said control mechanism being operatively interconnected for movement of said separator plate into said stream after a selected number of sheets have moved into said stack.

2. The separator for a sheet stacker as claimed in claim 1, wherein said sheet counter is an electrically operative counter and said control mechanism includes an electric element, and said counter and said electric element are electrically connected together for actuation of said control mechanism.

3. The separator for a sheet stacker as claimed in claim 1, wherein said control mechanism includes a fluid cylinder assembly for extending and retracting said separator plate and thereby respectively displacing said separator plate into the stream and also out of the stack.

4. The separator for a sheet stacker as claimed in claim 3, including a fluid valve operatively connected with said fluid cylinder assembly for controlling operation of the latter, and a valve actuator operatively associated with said valve and being positionable in accordance with the position of said separator plate relative to said stack conveyor for operating said valve at the two end positions of movement of said separator plate along the extent of said stack conveyor.

5. The separator for a sheet stacker as claimed in claim 3, wherein said cylinder assembly and said separator plate are assembled to each other as a unit, and wherein said unit is pivotally mounted on said support at a pivot point intermediate said cylinder assembly and said separator plate in a manner whereby said unit is overbalanced toward said cylinder assembly when said separator plate is retracted by said cylinder assembly, and said control mechanism including a releasable latch operatively connected with said unit for retaining said unit in the overbalanced condition until the release of said latch.

6. The separator for a sheet stacker as claimed in claim 5, wherein said control mechanism includes an electric solenoid connected to said latch for release of said latch, and said sheet counter is an electrically operative counter.

7. The separator for a sheet stacker as claimed in claim 1, including an electric system of a motor and two clutches and a switch, with said motor in driving relation with said clutches which are in respective driving relation with said stack conveyor and said separator plate for the movement of said separator plate in the direction along the extent of said stack conveyor, and said switch being electrically connected with said clutches for alternate driving engagement of said clutches and thereby alternate driving movement of said separator plate and said stack conveyor.

8. The separator for a sheet stacker as claimed in claim 7, wherein said sheet counter is an electrically operative counter and said control mechanism includes an electric element, and said counter and said electric element are electrically connected together for actuation of said control mechanism.

9. The separator for a sheet stacker as claimed in claim 7, wherein said control mechanism includes a fluid cylinder assembly for extending and retracting said separator plate and thereby respectively displacing said separator plate into the stream and also out of the stack.

10. The separator for a sheet stacker as claimed in claim 9, including a fluid valve operatively connected with said fluid cylinder assembly for controlling operation of the latter, and a valve actuator operatively associated with said valve and being positionable in accordance with the position of said separator plate relative to said stack conveyor for operating said valve at the two end positions of movement of said separator plate along the extent of said stack conveyor.

11. The separator for a sheet stacker as claimed in claim 9, wherein said cylinder assembly and said separator plate are assembled to each other as a unit, and wherein said unit is pivotally mounted on said support at a pivot point intermediate said cylinder assembly and said separator plate in a manner whereby said unit is overbalanced toward said cylinder assembly when said separator plate is retracted by said cylinder assembly, and said control mechanism including a releasable latch operatively connected with said unit for retaining said unit in the overbalanced condition until the release of said latch.

12. The separator for a sheet stacker as claimed in claim 11, wherein said control mechanism includes an electric solenoid connected to said latch for release of said latch, and said sheet counter is an electrically operative counter.

* * * * *

REEXAMINATION CERTIFICATE (654th)

United States Patent [19] [11] B1 3,969,993

Stobb [45] Certificate Issued Mar. 24, 1987

[54] SEPARATOR FOR A SHEET STACKER

[75] Inventor: Anton R. Stobb, Pittstown, N.J.

[73] Assignee: Stobb, Inc., Clinton, N.J.

Reexamination Request:
No. 90/000,998, Apr. 29, 1986

Reexamination Certificate for:

| | |
|---|---|
| Patent No.: | **3,969,993** |
| Issued: | **Jul. 20, 1976** |
| Appl. No.: | **593,849** |
| Filed: | **Jul. 7, 1975** |

[51] Int. Cl.[4] ..... B31B 1/98

[52] U.S. Cl. ..... 414/48; 271/218; 414/50; 414/82

[58] Field of Search ..... 414/48, 50, 82; 271/215, 218

[56] References Cited

U.S. PATENT DOCUMENTS

| | | | |
|---|---|---|---|
| 2,205,767 | 6/1940 | Lamb | 414/218 X |
| 2,933,314 | 4/1960 | Stobb | 271/215 |
| 3,255,895 | 6/1966 | Klingler | 414/50 X |
| 3,279,792 | 10/1966 | Kostal et al. | 271/218 |
| 3,298,683 | 1/1967 | Stroud | 271/218 |
| 3,362,707 | 1/1968 | Lauren . | |
| 3,526,170 | 9/1970 | Oderman et al. . | |
| 3,831,505 | 8/1974 | Skogsberg . | |
| 3,892,168 | 7/1975 | Grobman . | |

FOREIGN PATENT DOCUMENTS

| | | |
|---|---|---|
| 1567574 | 5/1969 | France . |
| 1062131 | 3/1967 | United Kingdom . |
| 1239334 | 7/1971 | United Kingdom . |

*Primary Examiner*—L. J. Paperner

[57] ABSTRACT

A separator for a sheet stacker having a support for receiving a stack of sheets on a stack conveyor. Another conveyor brings a stream of sheets to the support, and a sheet counter counts the sheets and a stack separator plate is controlled by the counter and interrupts the stream when a certain number of sheets have passed into the stack. Drive mechanism connects to the separator plate and the stack conveyor for alternately driving them and thereby separating out a stack of sheets. The separator plate is automatically operated and is under the control of a fluid cylinder.

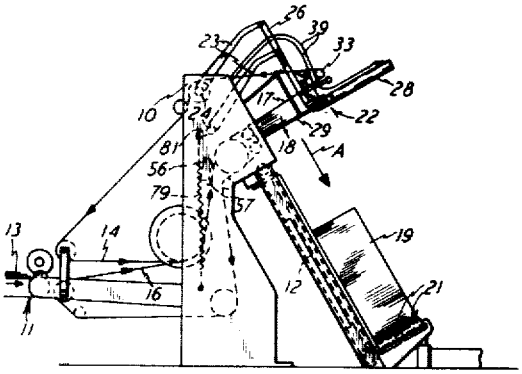

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2–12 are cancelled.

Claim 1 is determined to be patentable as amended.

New claims 13–22 are added and determined to be patentable.

1. A separator for a sheet stacker, comprising a support for receiving a stack of sheets, a stack conveyor on said support *and being movable downwardly thereon while collecting and supporting the sheets and uniformly lowering a stack of sheets on said support*, a conveyor assembly extending to said support *and to said stack* for transporting sheets in *the formation of* a stream *of imbricated sheets* and into [a] *the* stacked relation on said stack conveyor *where the stack is initially formed while said stream of imbricated sheets is moving into the stack*, a sheet counter for counting the sheets passing into the stacked relation, a stack separator plate movably mounted adjacent said stack conveyor [for movement] *and having an extended end with a tip movable to a position below said conveyor assembly and* into said stream *of imbricated sheets* for intercepting said stream *of imbricated sheets in their stream relation* and [for movement] *said separator plate being movable* in the direction along the extent of said stack conveyor *and being movable downwardly only in unison with the speed of the incoming stream of imbricated sheets forming said stack while said stack is growing on said separator plate and* for *subsequently* defining one end of a stack of sheets on said stack conveyor, control mechanism operatively connected with said stack separator plate [for movement of] *and including a fluid cylinder assembly for extending and retracting* said stack separator [plte] *plate and thereby respectively displacing said separator plate* into [the] *said* stream *of imbricated sheets and also out of said stack*, and said sheet counter and said control mechanism being operatively interconnected for movement of said separator plate into said stream *of imbricated sheets* after a selected number of sheets have moved into said stack[.] , *said separator plate being controlled by said control mechanism to be movable downwardly to guide said one end of said stack downwardly while said stack conveyor is lowering a full stack of sheets, a fluid valve operatively connected with said fluid cylinder assembly for controlling operation of the latter, and a valve actuator operatively associated with said valve and being positionable in accordance with the position of said separator plate relative to said stack conveyor for operating said valve at the two end positions of movement of said separator plate along the extent of said stack conveyor.*

*13. The separator for a sheet stacker as claimed in claim 1, wherein said sheet counter is an electrically operative counter and said control mechanism includes an electric element, and said counter and said electric element are electrically connected together for actuation of said control mechanism.*

*14. A separator for a sheet stacker, comprising a support for receiving a stack of sheets, a stack conveyor on said support and being movable downwardly thereon while collecting and supporting the sheets and uniformly lowering a stack of sheets on said support, a conveyor assembly extending to said support and to said stack for transporting sheets in the formation of a stream of imbricated sheets and into the stacked relation on said stack conveyor where the stack is initially formed while said stream of imbricated sheets is moving into the stack, a sheet counter for counting the sheets passing into the stacked relation, a stack separator plate movably mounted adjacent said stack conveyor and having an extended end with a tip movable to a position below said conveyor assembly and into said stream of imbricated sheets for intercepting said stream of imbricated sheets in their stream relation and said separator plate being movable in the direction along the extent of said stack conveyor and being movable downwardly only in unison with the speed of the incoming stream of imbricated sheets forming said stack while said stack is growing on said separator plate and for subsequently defining one end of a stack of sheets on said stack conveyor, control mechanism operatively connected with said stack separator plate for movement of said stack separator plate into said stream of imbricated sheets, and said sheet counter and said control mechanism being operatively interconnected for movement of said separator plate into said stream of imbricated sheets after a selected number of sheets have moved into said stack, and said separator plate being controlled by said control mechanism to be movable downwardly to guide said one end of said stack downwardly while said stack conveyor is lowering a full stack of sheets, an electric system of a motor and two clutches and a switch, with said motor in driving relation with said clutches which are in respective driving relation with said stack conveyor and said separator plate for the movement of said separator plate in the direction along the extent of said stack conveyor, and said motor being drivingly operative at a speed to achieve the lowering of said separator plate in unison with the speed of the incoming sheets forming the stack, and said switch being electrically connected with said clutches for alternate driving engagement of said clutches and thereby alternate driving movement of said separator plate and said stack conveyor.*

*15. The separator for a sheet stacker as claimed in claim 14, wherein said sheet counter is an electrically operative counter and said control mechanism includes an electric element, and said counter and said electric element are electrically connected together for actuation of said control mechanism.*

*16. The separator for a sheet stacker as claimed in claim 14, wherein said control mechanism includes a fluid cylinder assembly for extending and retracting said separator plate and thereby respectively displacing said separator plate into the stream and also out of the stack.*

*17. The separator for a sheet stacker as claimed in claim 16, including a fluid valve operatively connected with said fluid cylinder assembly for controlling operation of the latter, and a valve actuator operatively associated with said valve and being positionable in accordance with the position of said separator plate relative to said stack conveyor for operating said valve at the two end positions of movement of said separator plate along the extent of said stack conveyor.*

*18. The separator for a sheet stacker as claimed in claim 16, wherein said cylinder assembly and said separator plate are assembled to each other as a unit, and wherein said unit is pivotally mounted on said support at a pivot point intermediate said cylinder assembly and said separator plate in a manner whereby said unit is overbalanced toward said cylinder assembly when said separator plate is retracted by said cylinder assembly, and said control mechanism including a releasable latch operatively connected with said unit for retaining said unit in the overbalanced condition until the release of said latch.*

*19. The separator for a sheet stacker as claimed in claim 18, wherein said control mechanism includes an electric solenoid connected to said latch for release of said latch, and said sheet counter is an electrically operative counter.*

*20. A separator for a sheet stacker, comprising a support for receiving a stack of sheets, a stack conveyor on said support and being movable downwardly thereon while collecting and supporting the sheets and uniformly lowering a stack of sheets on said support, a conveyor assembly extending to said support and to said stack for transporting sheets in the formation of a stream of imbricated sheets and into the stacked relation on said stack conveyor where the stack is initially formed while said stream of imbricated sheets is moving into the stack, a sheet counter for counting the sheets passing into the stacked relation, a stack separator plate movably mounted adjacent said stack conveyor and having an extended end with a tip movable to a position below said conveyor assembly and into said stream of imbricated sheets for intercepting said stream of imbricated sheets in their stream relation and said separator plate being movable in the direction along the extent of said stack conveyor and being movable downwardly only in unison with the speed of the incoming stream of imbricated sheets forming said stack while said stack is growing on said separator plate and for subsequently defining one end of a stack of sheets on said stack conveyor, control mechanism operatively connected with said stack separator plate and including a fluid cylinder assembly for extending and retracting said stack separator plate and thereby respectively displacing said separator plate into said stream and also out of said stack, and said sheet counter and said control mechanism being operatively interconnected for movement of said separator plate into said stream of imbricated sheets after a selected number of sheets have moved into said stack, said separator plate being controlled by said control mechanism to be movable downwardly to guide said one end of said stack downwardly while said stack conveyor is lowering a full stack of sheets, said cylinder assembly and said separator plate are assembled to each other as a unit, and wherein said unit is pivotally mounted on said support at a pivot point intermediate said cylinder assembly and said separator plate in a manner whereby said unit is overbalanced toward said cylinder assembly when said separator plate is retracted by said cylinder assembly, and said control mechanism including a releasable latch operatively connected with said unit for retaining said unit in the overbalanced condition until the release of said latch.*

*21. The separator for a sheet stacker as claimed in claim 20, wherein said control mechanism includes an electric solenoid connected to said latch for release of said latch, and said sheet counter is an electrically operative counter.*

*22. The separator for a sheet stacker as claimed in claim 20, wherein said sheet counter is an electrically operative counter and said control mechanism includes an electric element, and said counter and said electric element are electrically connected together for actuation of said control mechanism.*

* * * * *